United States Patent [19]

Yamamoto et al.

[11] Patent Number: 5,051,784

[45] Date of Patent: Sep. 24, 1991

[54] IMAGE FIXING APPARATUS WITH ROUGHENED FILM IN SLIDING CONTACT WITH HEATER

[75] Inventors: Akira Yamamoto, Tokyo; Shigeo Kumura, Yokohama; Kensaku Kusaka, Kawasaki; Hidekazu Maruta, Hachiohji; Hiroyuki Adachi, Tokyo, all of Japan

[73] Assignee: Canon Kabushiki Kaisha, Tokyo, Japan

[21] Appl. No.: 542,064

[22] Filed: Jun. 22, 1990

[30] Foreign Application Priority Data

Jun. 22, 1989 [JP] Japan ..... 1-160275

[51] Int. Cl.[5] ..... G03G 15/20

[52] U.S. Cl. ..... 355/285; 219/216; 355/282

[58] Field of Search ..... 355/282, 284, 285, 290, 355/295; 219/216; 250/316.1, 317.1, 318, 319; 432/59, 60; 430/98, 99, 100, 124

[56] References Cited

U.S. PATENT DOCUMENTS

| | | | |
|---|---|---|---|
| 3,810,735 | 5/1974 | Moser | 219/216 X |
| 3,811,828 | 5/1974 | Ohta et al. | 219/216 X |
| 4,132,882 | 1/1979 | Endo et al. | 219/216 |
| 4,566,779 | 1/1986 | Coli et al. | 355/212 |
| 4,714,427 | 12/1987 | Tsuruoka et al. | 219/216 X |
| 4,780,742 | 10/1988 | Takahashi et al. | 355/290 |
| 4,954,845 | 9/1990 | Yano et al. | 355/290 |

FOREIGN PATENT DOCUMENTS

| | | | |
|---|---|---|---|
| 0295901 | 12/1988 | European Pat. Off. | 355/285 |

*Primary Examiner*—Joan H. Pendegrass
*Assistant Examiner*—William J. Royer
*Attorney, Agent, or Firm*—Fitzpatrick, Cella, Harper & Scinto

[57] ABSTRACT

An image fixing apparatus includes a heater which is stationary in use; a film for sliding contact with the heater and movable together with a recording material, wherein the recording material has a visualized image, which is heated through the film by heat from the heater; and wherein that surface of the film for sliding contact with the heater has a surface roughness of 0.5–7 microns at least in a direction perpendicular to a movement direction of the film.

12 Claims, 4 Drawing Sheets

IMAGE FIXING APPARATUS WITH ROUGHENED FILM IN SLIDING CONTACT WITH HEATER

FIELD OF THE INVENTION AND RELATED ART

The present invention relates to an image fixing apparatus wherein a visualized image is heated and fixed through a film sliding relative to a heating member.

In a widely used conventional image fixing apparatus wherein the toner image is fixed on the recording medium supporting an unfixed toner image, the recording material is passed through a nip formed between a heating roller maintained at a predetermined temperature and a pressing or back-up roller having an elastic layer and press-contacted to the heating roller.

This heat roll fixing system requires that the heating roller has a large thermal capacity in order to prevent the temperature change of the heating roller, with the result that the waiting period until the surface of the heating roller reaches a predetermined temperature level is long.

U.S. Pat. No. 3,578,797 proposes a belt fixing apparatus wherein a web and the recording material is separated after the heated toner image is cooled. This belt type fixing system is advantageous over the heat roller type fixing system from the standpoint of the necessity of a measure against the temperature change.

However, the waiting period is not significantly shortened.

There are other systems such as flash fixing system or an oven fixing system, which, however, are bulky, and the thermal efficiency is not good.

In order to solve this problem, U.S. application Ser. Nos. 206,767, 387,970, 409,431, 416,539, 426,082, 435,427, 440,380, 440,678, 444,802, 446,449, 496,957, 502,223 proposes an image fixing apparatus having a fixed heater and a heat-resistive fixing film in a sliding contact with the heater, wherein the toner image is fused through the film. With the fixing apparatus, the power consumption is small, and the waiting period can be eliminated or significantly reduced.

However, the sliding contact between the film and the heater produces noise in some cases.

In addition, where the fixing film is in the form of an endless belt, the film gradually shifts in the lateral direction due to the dimensional inaccuracy of a belt driving roll or a driven roll, due to diameter variation thereof attributable to a thermal expansion or due to variation in the friction force between the heating member and the film, when the fixing apparatus is operated for a long period of time.

SUMMARY OF THE INVENTION

Accordingly, it is a principal object of the present invention to provide an image fixing apparatus wherein the noise due to the sliding contact between the heater and the film is prevented.

It is another object of the present invention to provide an image fixing apparatus wherein the lateral shift of the film is controlled in good order.

It is a further object of the present invention to provide an image fixing apparatus wherein the sliding surface of the film relative to the heater is roughened.

According to an embodiment of the present invention, there is provided an image fixing apparatus wherein the surface roughness of the film is 0.5–7 microns.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, embodiments of the present invention will be described.

Figure 5:
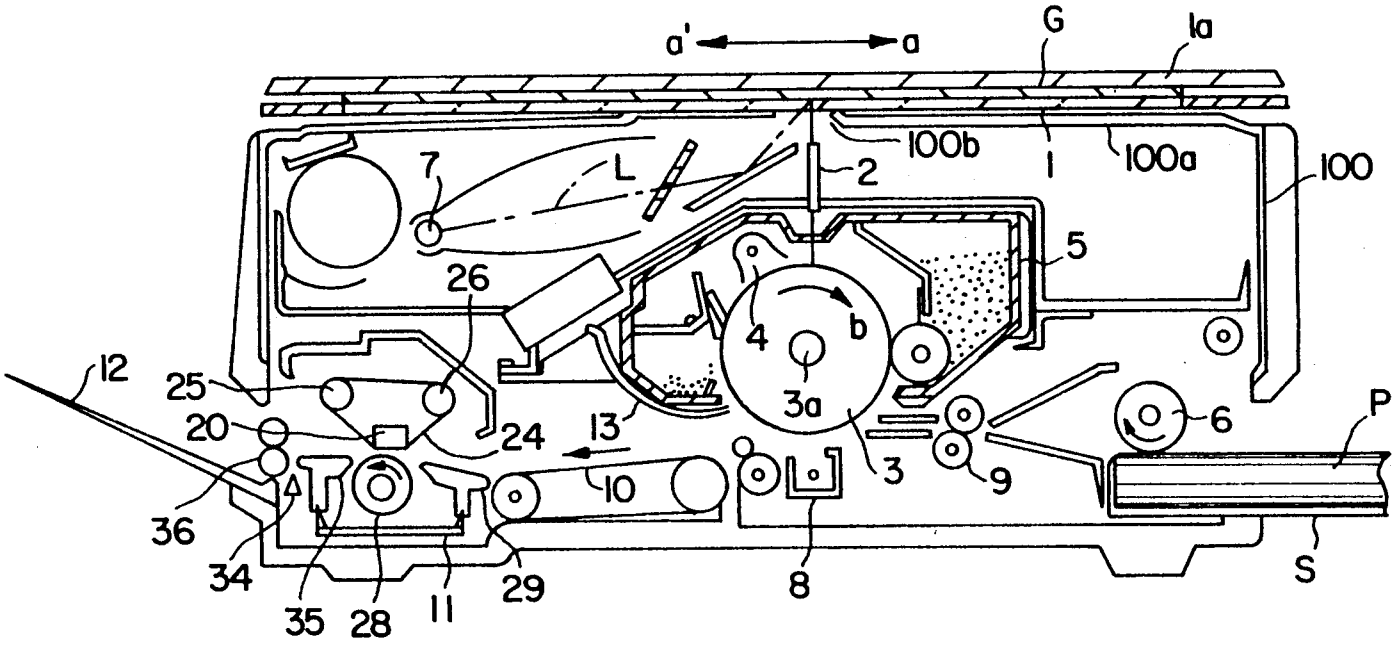
FIG. 5 is a sectional view of an image forming apparatus using an image fixing apparatus according to an embodiment of the present invention.

Referring first to FIG. 5, there is shown an electrophotographic copying apparatus as an exemplary image forming apparatus using an image fixing apparatus according to the present invention.

In FIG. 5, the apparatus comprises a housing 100, a reciprocable original supporting platen 1 made of transparent member such as glass plate disposed on the top plate 100*a* of the housing 100, wherein the original supporting platen 1 is reciprocable rightwardly (a) and leftwardly (a') on the top plate 100*a* at predetermined speeds.

An original G is placed face down on the original supporting platen 1 at a predetermined placing reference, and is covered by an original cover 1*a*.

A slit opening 100*b* is formed on the top plate 100*a* extending in a direction perpendicular to the reciprocable movement direction of the original supporting platen (perpendicular to the sheet of the drawing). The slit constitute a part of the original illuminating system. The face-down image surface of the original G placed on the original supporting platen 1 passes by the slid opening 100*b* during the movement of the original supporting platen 1 toward the right side (a). During the passage, the light L of the lamp 7 illuminates the original G through the slit opening 100*b* and the transparent original supporting platen 1. The light reflected by the original is imaged on the surface of the photosensitive drum 3 through an array 2 of imaging elements having a short focus and a small diameter.

The photosensitive drum 3 is coated with a photosensitive layer such as zinc oxide photosensitive layer or an organic photoconductor photosensitive layer. It is rotatable about a central axis 3*a* at a predetermined peripheral speed in the clockwise direction (b). During the rotation, the photosensitive drum 3 is uniformly charged to a positive or negative polarity by a charger 4, and the uniformly charged surface is exposed to the image light of the original through the slit opening, so that an electrostatic latent image corresponding to the light image is sequentially formed on the surface of the photosensitive drum 3.

The electrostatic latent image is visualized into a toner image with heat-softening or -fusing resin or the like by the developing device 5, and the visualized toner image is conveyed to the image transfer station having the transfer discharger 8.

The transfer material sheets P are contained in a cassette S. The sheet is singled out from the cassette by rotation of a pick-up roller 6 and is fed to the photosensitive drum 3 by feed rollers 9 in such a timed relationship that when the leading edge of the toner image formed portion on the drum 3 reaches the transfer discharger 8, the leading edge of the transfer sheet P reaches the position between the transfer discharger 8 and the photosensitive drum 3. By the transfer discharger 8, the toner image is sequentially transferred onto the fed sheet from the photosensitive drum 3.

The sheet having received the toner image is sequentially separated from the surface of the photosensitive drum 3 by an unshown separating means and is introduced by conveying device 10 to an image fixing apparatus 11, where the unfixed toner image is heat-fixed. Thereafter, it is discharged onto the discharge tray outside the apparatus as a final print (copy) by a guide 35 and discharging rollers 36.

On the other hand, the surface of the photosensitive drum 3 having been subjected to the toner image transfer operation is cleaned by the cleaning device 13 so that the residual toner or other contamination are removed to be prepared for the next image forming operation.

Figure 4:
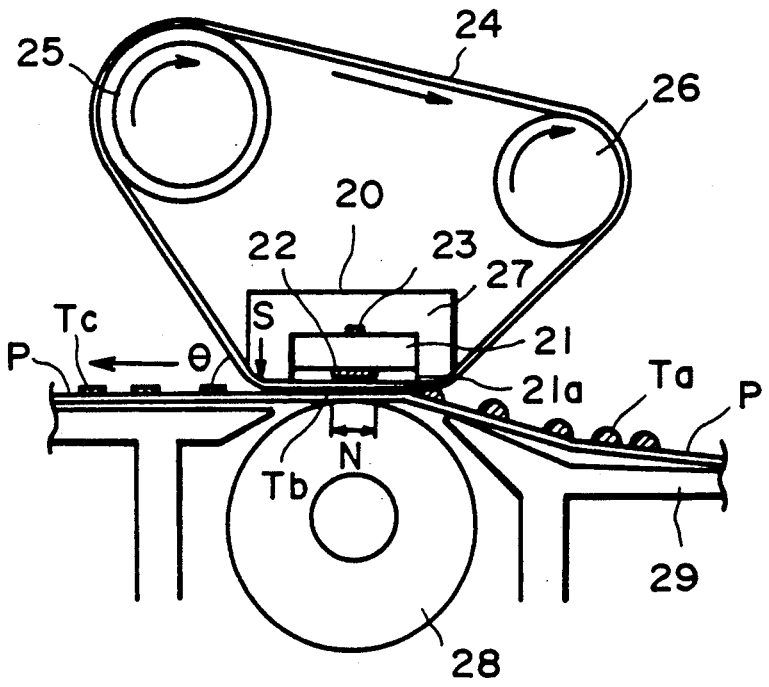
FIGS. 4, 6, 7 and 8 are sectional views illustrating image fixing apparatuses according to further embodiments of the present invention.

Referring to FIG. 4, an image fixing apparatus according to an embodiment of the present invention will be described.

An image fixing film 24 is in the form of an endless belt, and is stretched around four parallel members, i.e., a driving roller (left side) 25, a driven roller (right side) 26, a linear heater which has a low thermal capacity and which is disposed at a lower position between said driving roller 25 and the driven roller 26 and a heater supporting member 27. The fixing film 24 will be described in detail hereinafter.

The driven roller or follower roller 26 functions also as a tension roller for the endless fixing film 24. When the driving roller 25 rotates in the clockwise direction, the fixing film 24 rotates also in the clockwise direction at a predetermined peripheral speed, that is, the same speed as the conveying speed of the transfer sheet P conveyed from the image forming station and carrying thereon an unfixed toner image Ta, without speed difference, without production of crease and without snaking motion.

A pressing roller (pressing member) 28 has a rubber elastic layer made of rubber material having good parting property such as silicone rubber. It is urged, by unshown urging means, toward the bottom surface of the heater 20 with the total pressure of 4–7 Kg with the bottom travel of the fixing film 24 sandwiched therebetween. The pressing roller 28 rotates in the counterclockwise direction, that is, in the same peripheral movement direction as the transfer sheet P.

The heater 20 having the low thermal capacity and having the linear shape, in this embodiment, comprises the heater supporting member 27 extending in the direction of the width of the fixing film 24 (perpendicular to the movement direction of the fixing film 24). The supporting member has sufficient rigidity, heat-resistivity and heat-insulation properties. The heater 20 also comprises a heater highly heat-conductive base 21 mounted on the bottom surface of the supporting member 27 and extended along the length of the supporting member 27. The heater base is provided with a heat generating element 22 and a temperature detecting element 23.

The heater supporting member 27 functions to support the heater 20 on the fixing apparatus, and therefore, on the image forming apparatus with sufficient thermal insulation. Examples of usable materials for the heater supporting member 27 are high heat-resistivity resins such as PPS (polyphenylenesulfide), PAI (polyimide amide), PI (polyimide), PEEK (polyether ether ketone) or liquid crystal resins, or composites of such a resin and ceramic material, metal, glass or the like. The supporting member 27 is thus made of low heat-conductive material.

The heater base 21 has, for example, an alumina plate having a thickness of 1.0 mm, a width of 10 mm and a length of 240 mm. The heat generating element 22 is applied through a screen printing process or the like on the bottom surface of the base 21 along the length thereof. It is made of electric resistance material such as Ag/Pd (silver-palladium), for example, and has a thickness of approx. 10 microns and a width of 1 –3 mm. The heat generating element 22 is coated with a heat-resistive glass having a thickness of approx. 10 microns as a surface protection layer.

The temperature sensor 23 is, for example, a temperature detecting element applied through a screen printing process on the top surface (opposite from the surface having the heat generating element 22 at the center thereof. It is made of Pt film or the like having a low thermal capacity. The temperature sensor 23 may be in the form of a thermister having a low thermal capacity contacted to the base 21.

In this embodiment, the linear or strap form heat generating member 22 is connected with electric power at the opposite longitudinal ends, so that the heat is generated over the entire length thereof. The power is AC 100 V in this example. In response to the output of the temperature sensor 23, the power supply to the heat generating member is controlled by changing a phase angle of the electric power supplied from an unshown power supply circuit.

Figure 6:
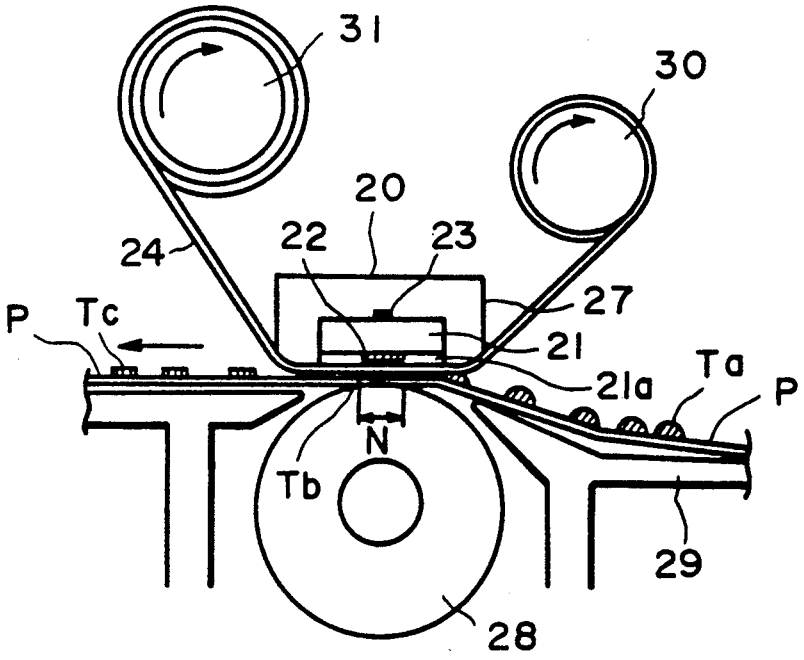

The fixing film 24 in not limited to an endless belt, but may be a non-endless belt wrapped on a supply shaft 30 and on a take-up shaft 31 through the nip formed between the heater 20 and the pressing roller 28, as shown in FIG. 6. The film 24 in this form is moved from the supply shaft 30 side to the take-up shaft 31 side at the same speed as the transfer material conveying speed.

The image fixing operation of the apparatus of this embodiment will be described.

Upon image formation start signal, the image forming apparatus starts to form an image. A visualized toner powder image is formed on the transfer sheet P, and the transfer sheet having the toner image Ta is conveyed from the transfer station 8 to the image fixing apparatus 11. It is introduced along the guide 29 into the nip N formed between the pressing roller 28 and the fixing film 24 urged by the pressing roller toward the heater 20, and is passed through the nip together with the fixing film in contact with the bottom surface of the film without relative movement therebetween and without production of crease.

The heater 20 is energized at predetermined timing from the image formation start signal, so that the toner image Ta is heated at the nip N and is fused into a fused image Tb. Since there is no air layer between the heat generating element 22 and the toner, and therefore, the energy transmission efficiency is high.

The movement direction of the fixing film 24 abruptly changes by as large as approx. 45 degrees ($=\theta$) at an edge S of the supporting member which has a large curvature (radius of approx. 2 mm). The sheet P which comes through the nip N with the fixing film 24 in contact is separated by the abrupt increase of the curvature from the fixing film 24 at the edge S. It is conveyed to the discharge tray 12. By the time of the sheet P reaching the discharge tray 12, the toner is sufficiently cooled and solidified so as to be completely fixed on the sheet P into the fixed toner image Tc.

The toner used in this embodiment has sufficiently high viscosity when heated and fused to provide far higher adherence among toner particles that the adherence between the toner and the fixing film 24, even if the temperature of the toner at the time of the separation thereof from the fixing film 24 is higher than the melting point of the toner. For this reason, substantially no toner offset occurs to the fixing film 24 when the sheet is separated from the fixing film 24.

In this embodiment, the thermal capacities of the heat generating element 22 and the base 21 of the heater 20 are small, and are supported by the supporting member with the thermal insulation provided by the supporting member 27, so that the surface temperature of the heater 20 at the nip N rapidly raised to a level sufficiently higher than the toner fusing point (or the fixable temperature relative to the sheet P). Therefore, there is no need of stand-by heating to heat the heater beforehand. Accordingly, the energy consumption can be saved, and the temperature rise in the apparatus can be prevented.

Figure 7:
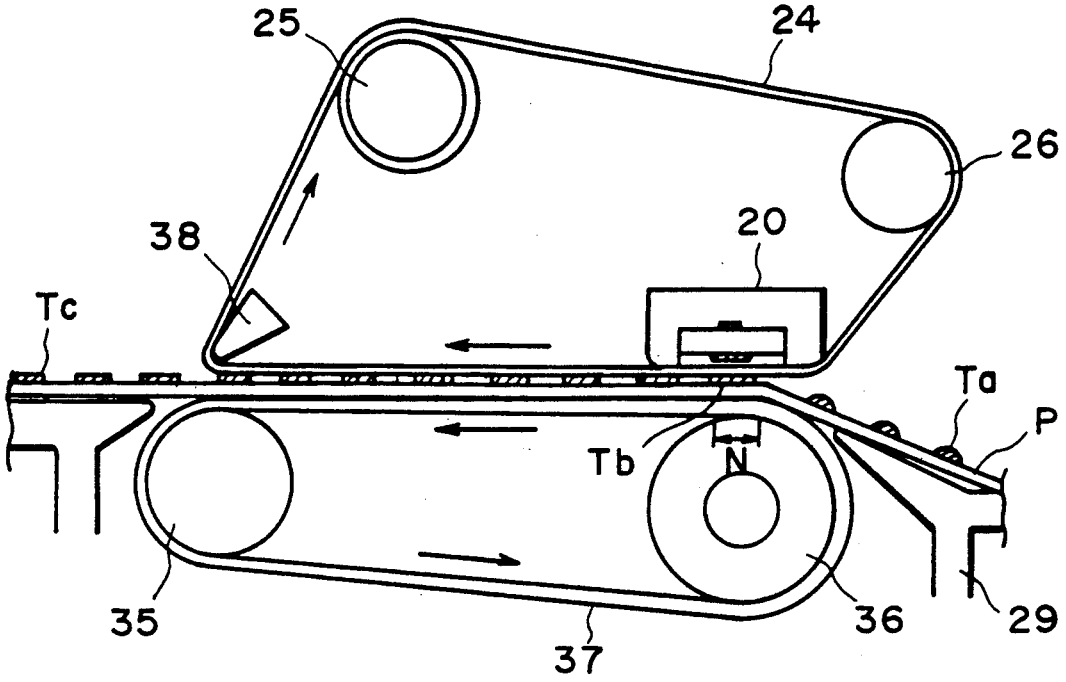

FIG. 7 is a sectional view illustrating an image fixing apparatus according to another embodiment of the present invention.

The fixing apparatus comprises an upper separation stay 38 having a small diameter and disposed downstream of the heater 20 with respect to the conveyance direction of the sheet P, a driving roller 25 for rotationally traveling the fixing film, and a follower or driven roller 26 for applying proper tension at all times to the fixing film. The driving roller 25 is rotated in the clockwise direction at the same speed as the sheet conveyance speed.

An image fixing film 24 is stretched around four parallel members 20, 38, 25 and 26.

The apparatus further comprises a pressing roller 36 disposed below the heater 20, a lower separation roller 35 disposed below a separation stay 38, a conveyer belt (back-up belt) 37 in the form of an endless belt stretched around the pressing roller 36 and the lower separation roller 35. The pressing roller 36 has a surface layer made of elastic material such as silicone rubber. Between the pressing roller 36 and the heater 20, the bottom travel of the endless fixing film 24 is sandwiched, and the total pressure of 4–7 kg is applied by an unshown urging means.

When the film 24 is rotationally driven, the pressing roller 36 rotates, by which the conveyer belt 37 rotates in the counterclockwise direction at the same speed as the sheet conveyance speed, while press-contacting the sheet P to the fixing film 34.

In operation, upon image formation start signal, the image forming apparatus starts to form an image. A visualized unfixed toner image is formed on the transfer sheet P, and thereafter the transfer sheet having the toner image Ta is conveyed from the transfer station to the image fixing apparatus 11. It is introduced along the guide 29, while the fixing film 24 and the conveyer belt 37 are rotated, into the nip N formed between the pressing roller 28 and the fixing film 24 urged by the pressing roller toward the heater 20, and is passed through the nip together with the fixing film in contact with the bottom surface of the film without relative movement therebetween and without production of crease.

During the passage through the nip N, the toner image Ta is heated and is fused into a fused image Tb.

The portion of the sheet having passed through the nip N between the pressing roller 36 and the heating roller 32, continues to be conveyed in close contact with the fixing film stretched between the heating roller 32 and the separation stay 38, before the portion reaches to the separation stay 38. The conveyer belt 37 supports the backside of the sheet P to maintain the close-contactness between the sheet P and the fixing film 24. During the conveyance process, the sheet of the softened/fused toner image Tb is radiated, by which a cooled/solidified toner image Tc is produced. The heat radiation in this radiation and cooling process is provided by the spontaneous radiation in this embodiment. However, a forced cooling may be employed with the use of a heat radiation fins or with the use of a fan.

When the portion reaches the separation stay 38, the fixing film 24 is deflected by the stay 38 away from the sheet P surface with a large deflection angle, by which the fixing film 24 and the sheet P are separated from each other. Then, the sheet P is conveyed to the discharging tray 12. By the time of the separation, the toner is sufficiently cooled and solidified, so that the adherence of the toner to the sheet P is sufficiently large, whereas the adherence to the fixing film 24 is very small, so that the separation between the fixing film 24 and the sheet P is performed substantially without toner offset to the fixing film 24.

According to this embodiment, the set temperature of the heater is further increased. More particularly, the set temperature may be far higher than the temperature at which the high temperature offset is produced in the conventional heating roller type fixing system. By the increase of the temperature, the fixing performance is enhanced. In addition, the tolerable temperature range of the heater is larger at the high temperature side, so that the temperature control system is easy.

In addition, when the toner images of different, particularly three or more different color toners are fixed together (color mixture), the toner can be fused at the high temperature, and therefore, the color mixture is good. In addition, since the toner is once fused, and the fused toner is cooled and solidified while being in contact with the fixing film and thereafter, it is separated from the fixing film, then the surface of the toner image follows the surface property of the fixing film. Therefore, if the fixing film is given the smooth surface, the surface of the toner image Tc can be as glossy as a silver salt photograph.

By reducing the thickness of the fixing film 24, the heat accumulation in the fixing film can be prevented, by which the cooling efficiency of the toner image is improved. Where the fixing film is made of thin resin, the contactness with the toner image is improved, so that the heat transfer efficiency is further improved.

Figure 8:
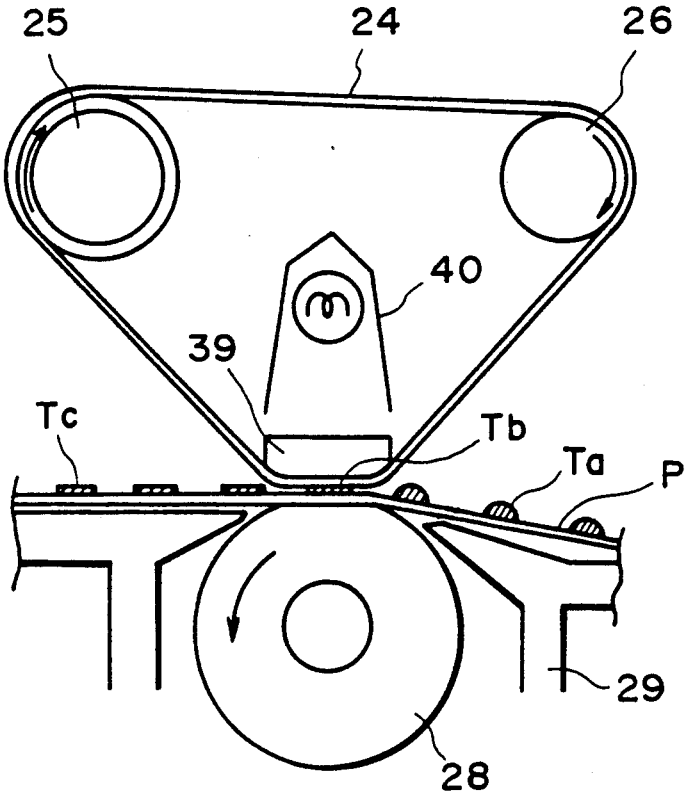

FIG. 8 shows an image fixing apparatus according to a further embodiment of the present invention.

In place of the heater 20 of the first embodiment (FIG. 4), the present embodiment employs a transparent member 39 made of heat-resistive glass or the like, and through the transparent member, the toner image is heated by a heat-radiation source 40 such as halogen lamp disposed inside the endless fixing film 24.

In this embodiment, the toner is heated by the radiation by the instantaneous temperature rise, heating and the fusing. From the standpoint of the higher energy transmission efficiency, the use of the heater 20 in the foregoing embodiment is preferable since the temperature of the heater 20 is instantaneously raised.

Where an endless film is used as in the embodiments of FIG. 4, 7 and 8, in order to prevent lateral shifting of the endless film in a long term use, film shift control means not shown is provided to change the tension to the film supported on the rollers 25 and 26 and the heater 20 at the longitudinal end or ends of the rollers, or means is provided to change a level or levels of the roller or rollers. Another means is usable for the same purpose.

Figure 1:
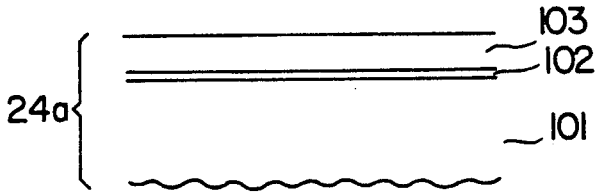
FIG. 1 is a sectional view of an image fixing film used with the apparatus according to an embodiment of the present invention.
Figure 2:
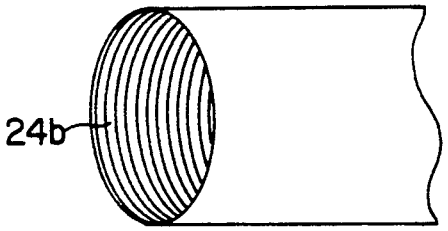
FIG. 2 is a perspective view of an endless film used in an image fixing apparatus according to an embodiment of the present invention.
Figure 3:
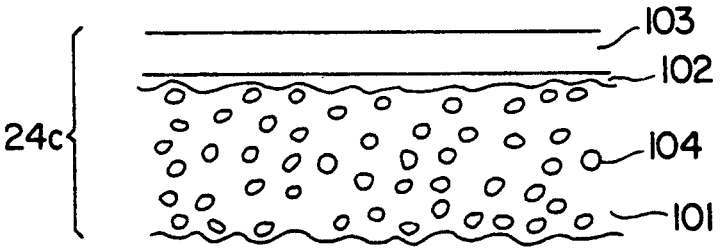
FIG. 3 is a sectional view of a film used in an image fixing apparatus according to an embodiment of the present invention.

Referring now to FIGS. 1–3, the fixing film of this embodiment will be described. In these Figures, references 24*a* and 24*c* represent thicknesses of the film. The films are used as the fixing film 24 in the embodiment described in the foregoing.

EXAMPLE 1

As shown in FIG. 1, the film comprises a polyimide film 101 having a thickness of 30 microns, a primer layer 102 and a parting layer 103 made of PTFE. The polyimide surface of the film is sand-blasted, while the parting layer side is contacted to a steel plate, so that the surface roughness of Rz 2 microns is provided.

EXAMPLE 2

As shown in FIG. 2, the film is in the form of an endless film made of polyimide. The film has projections 24*b* of 5 microns extending along the movement detection of the film, so that the surface thereof is rough in the direction perpendicular to the movement direction. This film can be produced by applying precursor of the polyimide on the outer periphery of a cylindrical dye and by drying it into the polyimide. The cylindrical dye has the peripheral surface with trace of fine abrasion or fine cutting extending in the circumferential direction.

Depending on the manner of the roughing of the surface of the dye, the roughness of the inside surface of the film can be changed. For example, if the surface is sand-blasted, the same roughness as in the first example can be provided.

EXAMPLE 3

As shown in FIG. 3, the polyimide film contains filler material 104, by which the surface of the polyimide film is roughened by the influence of the filler material adjacent the surface. In this example, 1% of spherical silica particles are dispersed in the polyimide, by which the roughness of 2 microns can be provided on the polyimide surface. In this case, the similar roughness is produced on the parting layer side surface, and therefore, the bonding property of the parting layer is also improved.

The surface roughness Rz in the foregoing examples are based on ten point average roughness as stipulated in JIS B 0651 and JIS B 0606.

When the polyimide films of the foregoing examples were set in the fixing apparatus of FIG. 4 with the roughened surfaces at the side of the heater, both of the lateral shift control and the noise by the sliding contact between the heater and the film were good.

In FIG. 4, the glass layer 21*a* of the surface of the heater has the surface roughness of 0.5 micron. When the surface roughness of the film contacted thereto is not more than 0.5 micron, the heater and the film are adhered with the result of large friction force, and therefore, the noise is produced during the driving. In addition, the friction force with the driving roll 25 and the tension roll 26 is increased so much that the film is creased during the lateral shift control. If the surface roughness of the film is not less than 7 microns, the air gap between the heater is so increased that the heat transfer is obstructed, and therefore, the surface roughness is preferably 0.5–7 microns, further preferably, 1–5 microns.

The total thickness of the fixing film is preferably not more than 100 microns, further preferably not more than 50 microns, and not less than 10 microns from the standpoint of stabilized driving thereof. The material thereof is not limited to the polyimide resin if the heat-resistivity is good. Examples of the other materials are polyether ether ketone (PEEK), polyether sulfone (PES), polyether imide (PEI) and the like. The material of the parting layer may be PTFE, PFA, FEP or another fluorinated resin, or silicone resin, having the heat-resistivity and the parting property.

The method of roughing the surface of the film is not limited to the above Examples. Other Examples of the roughing methods are cutting, abrading, etching and the like.

As described in the foregoing, according to the present invention, the noise attributable to the sliding movement can be suppressed without decreasing the thermal efficiency.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater which is stationary in use; and a film movable in sliding contact with said heater at one side thereof and movable in contact with a recording material at the other side, wherein said one side of said film has a surface roughness of 0.5–7 microns.

2. An apparatus according to claim 1, wherein said surface on said one side of said film is of polyimide resin.

3. An apparatus according to claim 1, wherein said film contains filler material.

4. An apparatus according to claim 1, wherein at least said surface on said one side of said film is roughened.

5. An apparatus according to claim 1, wherein at least said surface on said one side of said film is sand-blasted.

6. An apparatus according to claim 1, wherein said film is produced with a dye having a roughened surface.

7. An apparatus according to claim 1, wherein a surface of said heater contactable with said film comprises a glass layer, and said film is in sliding contact with the glass layer.

8. An apparatus according to claim 1, wherein said surface of said film has a surface roughness of 1–5 microns.

9. An apparatus according to claim 8, wherein said film has a thickness of not more than 100 microns.

10. An apparatus according to claim 9, wherein said film has a thickness of not less than 10 microns and not more than 50 microns.

11. An apparatus according to claim 1, wherein said heater comprises a resistance material extending in a direction perpendicular to the movement direction of said film and producing heat by electric power supply thereto.

12. An apparatus according to claim 11, wherein there is no air layer between the resistance material and the visualized image.

* * * * *

UNITED STATES PATENT AND TRADEMARK OFFICE

CERTIFICATE OF CORRECTION

PATENT NO. : 5,051,784

DATED : September 24, 1991

INVENTOR(S) : YAMAMOTO et al.

It is certified that error appears in the above-identified patent and that said Letters Patent is hereby corrected as shown below:

ON TITLE PAGE:

[75] Inventors:
"Shigeo Kumura," should read --Shigeo Kimura,--.

COLUMN 2,
Line 48, "constitute" should read --constitutes--.

Signed and Sealed this

Twenty-ninth Day of September, 1992

*Attest:*

DOUGLAS B. COMER

*Attesting Officer*

*Acting Commissioner of Patents and Trademarks*